US005921322A

United States Patent [19]

Bonfield et al.

[11] Patent Number: 5,921,322

[45] Date of Patent: Jul. 13, 1999

[54] DEVICE FOR REGULATING SPEED OF DEPLOYMENT OF SPRINKLER HEADS IN PREACTIVE SPRINKLER SYSTEMS

[75] Inventors: Douglas A. Bonfield, St. Charles; Stanley J. Zielinski, Glendale Heights; Joseph J. Roling, Bartlett, all of Ill.

[73] Assignee: The Curran Company, Glendale Heights, Ill.

[21] Appl. No.: 08/782,069

[22] Filed: Jan. 13, 1997

[51] Int. Cl.[6] ..... A62C 35/68

[52] U.S. Cl. ..... 169/37; 239/204; 239/209

[58] Field of Search ..... 169/16, 17, 37, 169/38, 39, 40, 41, 90; 239/203, 204, 205, 208, 209

[56] References Cited

U.S. PATENT DOCUMENTS 3,067,823 12/1962 Kavanagh ..... 169/41

*Primary Examiner*—Andrew C. Pike
*Attorney, Agent, or Firm*—Cherskov & Flaynik

[57] ABSTRACT

A telescopic high pressure sprinkler system is provided with a plurality of gaskets forming sliding seals between the piston and the outer conduit. Thus, the volume between the piston and the outer conduit forms a fluid chamber that is compressed as the piston is deployed so as to dampen the acceleration of sprinkler deployment. Furthermore, bleeder holes are provided to regulate the fluid chamber's compression while the gaskets provide a cushion when the piston comes to a stop.

25 Claims, 3 Drawing Sheets

DEVICE FOR REGULATING SPEED OF DEPLOYMENT OF SPRINKLER HEADS IN PREACTIVE SPRINKLER SYSTEMS

BACKGROUND OF THE INVENTION

1. Field of the Invention

This invention relates to sprinkler systems and more specifically this invention relates to preaction telescopic automatic fire sprinkler systems in residential, commercial, and industrial buildings where the telescopic sprinkler assemblies are deployed repeatedly.

2. Background of the Invention

Automatic fire extinguisher sprinkler systems have become an integral part of modern residential, commercial, and industrial buildings. Automatic sprinkler systems also are used in agriculture and in several manufacturing processes. Commonly these systems include a network of pipes for distributing fluid (hereinafter designated as the "spray fluid") to a plurality of sprinkler heads. Often, the spray fluid is injected at high pressure in the pipe network only after a command therefor has been generated, either automatically, for instance, by a heat sensor for a fire-extinguishing system, or manually by an operator.

There are several applications where the sprinkler heads are not permanently installed in their spraying position but rather are installed in what are commonly referred to as "telescopic sprinkler systems". Some applications include anechoic enclosures, environmental chambers, and freezers.

In a telescopic sprinkler system, a sprinkler head is installed at a depending end of a conduit, or "piston". The first end of the piston is adapted to be slidably received by an "outer conduit" or cylinder. The outer conduit in turn is rigidly attached to the pipe network. When there is no high pressure in the fluid network, the piston is fully nested within the outer conduit. To deploy the sprinkler heads to their spraying positions, a high pressure fluid (for example either the spray fluid or compressed air) is injected into the network and the pistons are propelled outward at high speed until they strike a stop and suddenly come to rest.

Telescopic sprinkler systems also are utilized in a myriad of applications in addition to fire extinguishing. For instance, where a sprinkler system is used to provide water for agriculture or horticulture, the sprinkler heads are often installed underground so that they will not interfere with pedestrians, vehicles, or machinery above ground. Also, for esthetic reasons, some land owners prefer that the sprinkler heads not be visible when they are not in use. The same considerations apply to overhead sprinkler systems used for fire extinguishing. Often building users prefer that the sprinkler heads be recessed in the ceiling for esthetic reasons or because they would interfere with other equipment contained in the room. Moreover, designers of anechoic acoustical enclosures require that sprinkler heads be recessed in the ceiling so that they not generate unwanted reflections. Similarly, designers of enclosures shielded from radio frequency radiation require that the sprinkler heads be recessed so that they do not impart unwanted reflections.

High pressure telescopic sprinkler systems must be able to withstand repeated deployment. For instance, fire extinguisher systems are tested at regular intervals so as to ensure both that the piston pipes will deploy appropriately and that sprinkler heads are suitably positioned in case of a fire. This is accomplished by introducing high pressure air or water in the distribution system. This high pressure accelerates the piston downwardly and out of the outer conduit until it strikes a stop at very high velocity. High velocity piston/stop impacts cause the telescopic system to suffer considerable damage after only a small number of tests. Such slamming causes water to leak into the room. In extreme cases, either the stop, or a surface on the piston that is complementary to the stop, shears off causing the piston to shoot towards the floor of the facility. This leads to flooding and further damage in instances where the piston strikes an object. However, most damage is internal or otherwise undetected unless the telescopic system is taken apart after a test. Thus, tests of a telescopic sprinkling system provide inadequate assurance that the system will deploy properly in case of an actual fire.

Damage incurred by the telescopic system cannot be obviated by reducing the pressure of the fluid injected in the distribution network. Adequate operation of the sprayer heads require that the spray fluid be applied at high pressure. For such applications as fire extinguishing, a high volume of spray fluid must be sprayed as quickly as possible, requiring that the spray fluid be at high pressure. Finally, when the telescopic systems are not deployed frequently, there is considerable static friction impeding the deployment of the systems, and again high pressure is required to overcome this friction.

Examples of telescopic high pressure sprinkler systems are described in several United States patents. U.S. Pat. No. 3,194,316, issued Jul. 13, 1965, U.S. Pat. No. 3,847,392, issued Nov. 12, 1974, U.S. Pat. No. 3,675,952, issued Jul. 11, 1972, U.S. Pat. No. 4,091,872, issued Mar. 30, 1978, and U.S. Pat No. 5,160,174, issued Nov. 3, 1992, teach methods for adjusting the length of a telescopic sprinkler system when it is first installed but make no provision for regulating the speed of deployment of such systems. U.S. Pat No. 3,263,929, issued Aug. 2, 1966, is an overhead sprinkler system for watering lawns. It incorporates an air chamber complete with an evacuation port. The air chamber is used to selectively actuate a specific sprinkler, but again no provision is made for regulating the speed of deployment of the telescopic sprinkler.

A need exists in the art to provide telescopic sprinkler systems for fire extinguishing and other applications wherein the velocity of the piston/stop impact is regulated so as to prevent damage to the telescopic assembly during testing or in actual fire-suppression scenarios.

SUMMARY OF THE INVENTION

It is an object of the present invention to provide a device for the controlled deployment of telescopic sprinkler heads that overcomes many of the disadvantages of the prior art.

A principal object of the present invention is to provide a telescopic high pressure sprinkler system wherein the velocity of deployment of the sprinkler heads, each of which is attached to a piston nested in a cylinder, is regulated. A feature of the present invention is a plurality of gaskets or seals in sliding contact with the inner wall of the cylinder. An advantage of the present invention is that an air pocket, defined by positions of opposing gaskets, serves to dampen deployment speeds of the sprinkler head as the pocket is longitudinally shortened.

A further object of the present invention is to provide a telescopic high pressure sprinkler system wherein the velocity of deployment of sprinkler head pistons which are initially nested in conduit cylinders is substantially reduced at the end of deployment. A feature of the present invention is that a plurality of gaskets, in sliding contact with the inner wall of the piston cylinder, form a fluid chamber between the cylinder and the piston. An advantage of the present invention is that the fluid chamber is progressively compressed as the system is deployed and thus exerts a progressively higher counterpressure on the sprinkler piston.

Another object of the present invention is to provide a telescopic high pressure sprinkler system wherein a high pressure is exerted on a sprinkler head piston which is nested inside a cylinder, at the start of the system's deployment. A feature of the present invention is that the fluid chamber between the piston cylinder and the piston exerts a low counterpressure at the start deployment. An advantage of the present invention is that, at the start of deployment, the net force exerted on the piston is nearly equal to the maximum force which the high pressure of the sprinkler system can exert.

A further object of the present invention is to provide a telescopic high pressure sprinkler system wherein the velocity of deployment of the sprinkler heads is adjustable. A feature of the present invention is one or a plurality of venting means, such as bleeder holes with adjustable apertures to allow for the progressive evacuation of fluid such as air from a chamber defined by the outer surface of a piston containing the sprinkler head and an inner surface of a piston cylinder. An advantage of the present invention is that the bleeder holes allow the adjustment of the counterpressure exerted by said fluid chamber.

Yet another object of the present invention is to provide a telescopic high pressure sprinkler system wherein the impact between a piston carrying a sprinkler head and a piston cylinder is lessened. A feature of the present invention is one or a plurality of cushioning means, such as flexible gaskets or springs positioned between the rigid stops mounted on the piston and the cylinder. An advantage of the present invention is that the gaskets or springs cushion the impact between the piston and the outer conduit.

Still another object of the present invention is to allow already installed telescopic high pressure sprinkler systems to be modified so that the velocity of deployment of the sprinkler heads becomes adjustable. A feature of the present invention is that it requires a limited number of modifications on already installed sprinkler systems. An advantage of the present invention is that such sprinkler systems can be modified at low cost.

In brief, the objects and advantages of the present invention are achieved by providing a device for deploying sprinkler heads in a telescopic sprinkler system comprising a plurality of gaskets and a chamber containing fluid for dampening the speed of deployment of the sprinkler heads.

In addition, a device for deploying sprinkler heads in a preaction sprinkler system is provided comprising a conduit; a piston slidably received by said conduit, whereby the piston has a first end and a second end; a first seal positioned on the first end of the piston; a sprinkler head positioned on the second end of the piston; a second seal positioned on the conduit and circumferentially contacting a surface of the piston proximal to the sprinkler head so as to define a fluid space containing fluid between the first and the second seal when the piston is substantially contained by the conduit; and a stop attached to the first end of the piston and proximal to the first seal so that when a fluid contacts the stop with a sufficient force, the piston will travel toward the second seal a predetermined distance.

Furthermore, a device for deploying telescopic sprinkler systems is provided comprising a device for deploying sprinkler heads in a preactive sprinkler system comprising a first conduit having first and second ends; a second conduit longitudinally received within said first conduit; said second conduit having a first end with sealing means attached thereto for sealing an outer wall portion of said first end of said second conduit adjacent to a longitudinally varying inner wall portion of said first conduit; said second conduit having a second end with a means for distributing a fluid; means for sealing an inner wall portion of said second end of said first conduit adjacent to a longitudinally varying outer wall portion of said second conduit; and means for stopping said first end of said second conduit when a predetermined longitudinal movement of said second conduit has occurred.

BRIEF DESCRIPTION OF THE DRAWINGS

The present invention together with the above and other objects and advantages may best be understood from the following detailed description of the embodiment of the invention illustrated in the drawings, wherein.

DETAILED DESCRIPTION OF THE INVENTION

The present invention relates to high pressure automatic telescopic sprinkler systems wherein a first tubular member or pipe ("the piston") is slidably received by a second tubular member or pipe ("the outer conduit"), and wherein the piston is deployed at until it rests against a stop. The present invention employs a plurality of gaskets to create a fluid chamber within the telescopic sprinkler assembly. The fluid chamber acts as a brake by exerting a counterpressure against the piston, thereby regulating the velocity with which the piston strikes the stop. Optimally, the piston contains regions defining a means for venting fluid such as an aperture or a plurality of apertures hereinafter referred to as bleeder holes, which allow for the progressive evacuation of the fluid chamber so that the counterpressure can be adjusted.

Figure 1:
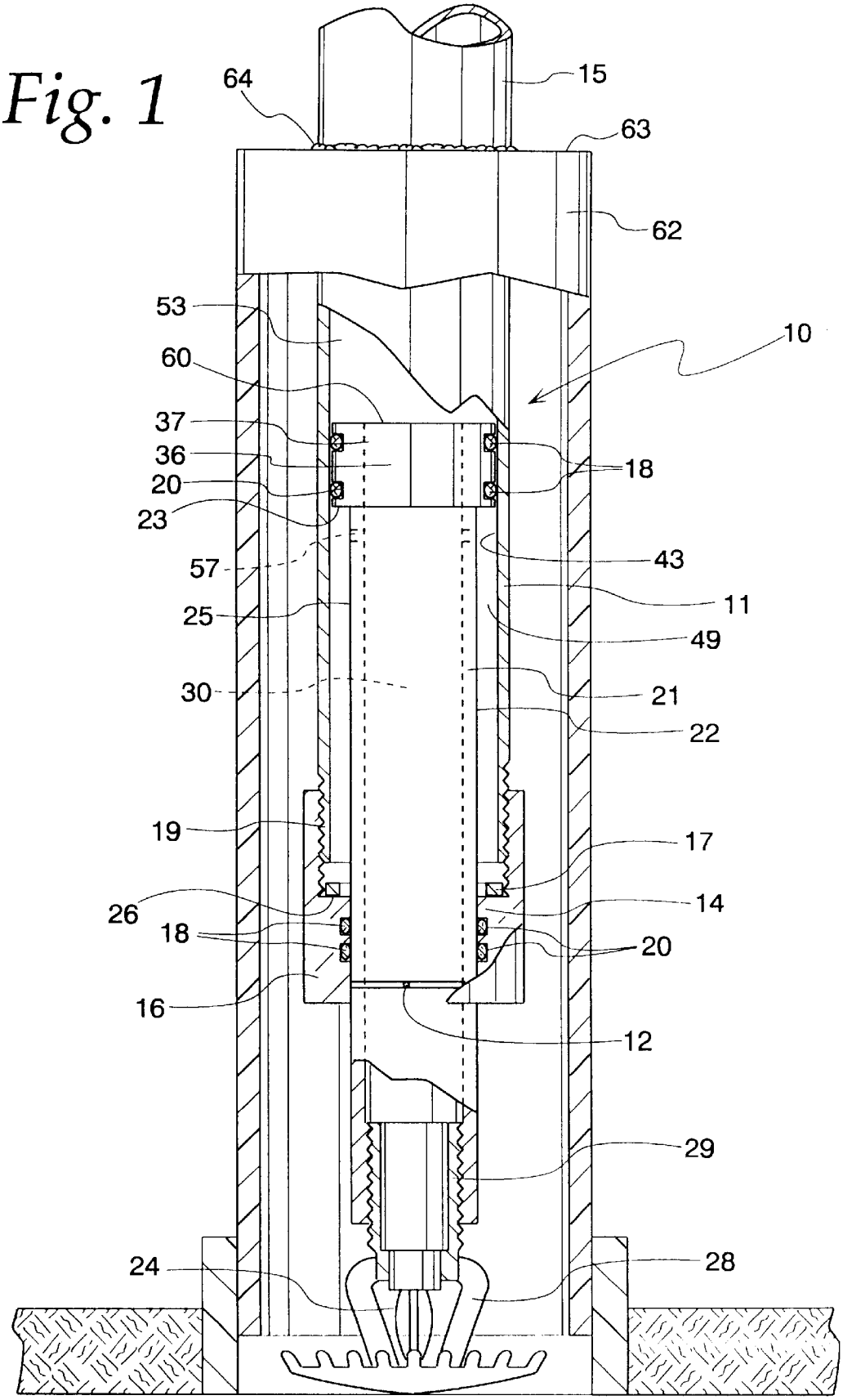
FIG. 1 is a cross-sectional view of an exemplary embodiment of the device in a "nested" configuration, in accordance with features of the present invention.

FIG. 1 depicts a cross sectional view of an exemplary embodiment of the present invention in a "nested" configuration. The invented device, designated generally as numeral 10, contains a first, generally cylindrical conduit 11 (hereinafter designated as the "outer conduit") with a first end 15 and a second end 19. The first end 15 is connected to the sprinkler system distribution network by means of a conventional Tee junction (not shown). A second generally cylindrical conduit 21 (hereinafter designated as the "piston"), having a first end 25 and a second end 29, is adapted to be slidably received by the outer conduit 11 in a piston-cylinder fashion.

Figure 4:
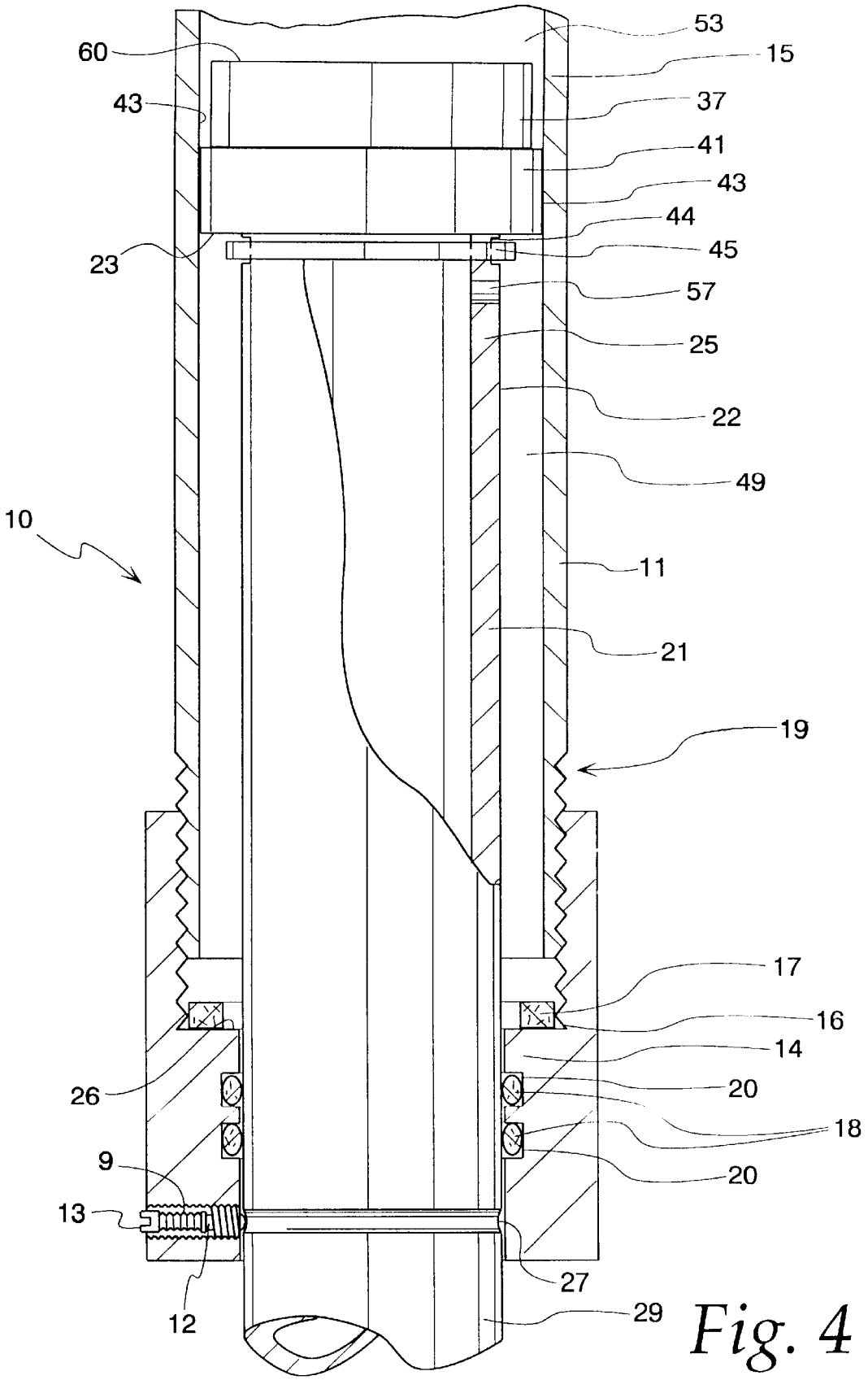
FIG. 4 is a partial detailed view of an exemplary device, in accordance with the features of the present invention.

As is more clearly depicted in FIG. 4, which is a partial cutaway of the device 10 without sprinkler head 28 detail, and with a slightly modified sealing means, a cylindrical mounting 16 is rigidly attached to the second end 19 of the outer conduit 11. The cylindrical mounting 16 can be attached by a myriad of attachment means, including welds or a threaded junction. The cylindrical mounting 16 comprises a stop 14 and a plurality of annular grooves 20 for the positioning of a plurality of gaskets 18, such as O-rings. The stop 14 is immobile relative to the piston 21. The gaskets 18 provide a primary, slidable seal between the mounting 16 and the outer wall 22 of the piston 21. Optionally, one may also position an annular gasket 17 so as to contact a surface 26 of the stop 14.

Figure 2:
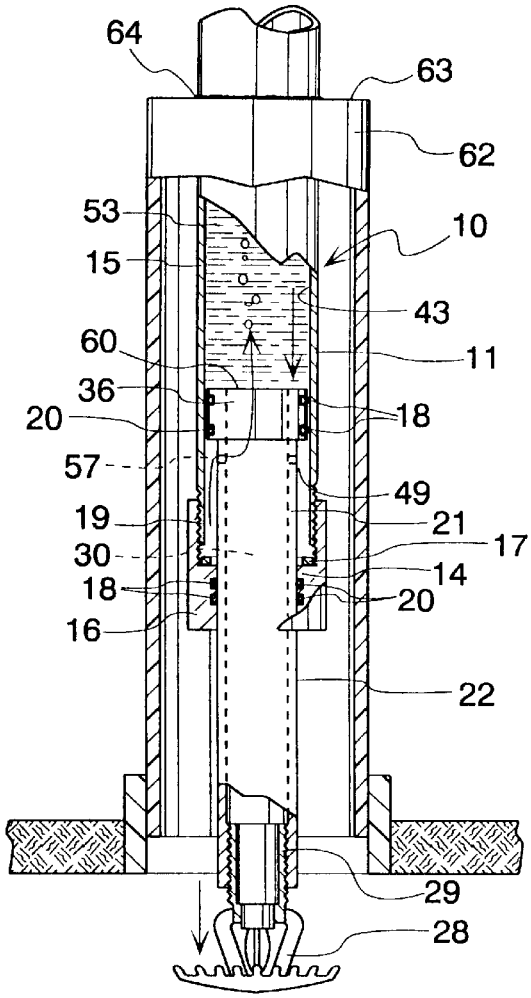
FIG. 2 is a cross sectional view of an exemplary device, depicting initial deployment, in accordance with features of the present invention.
Figure 3:
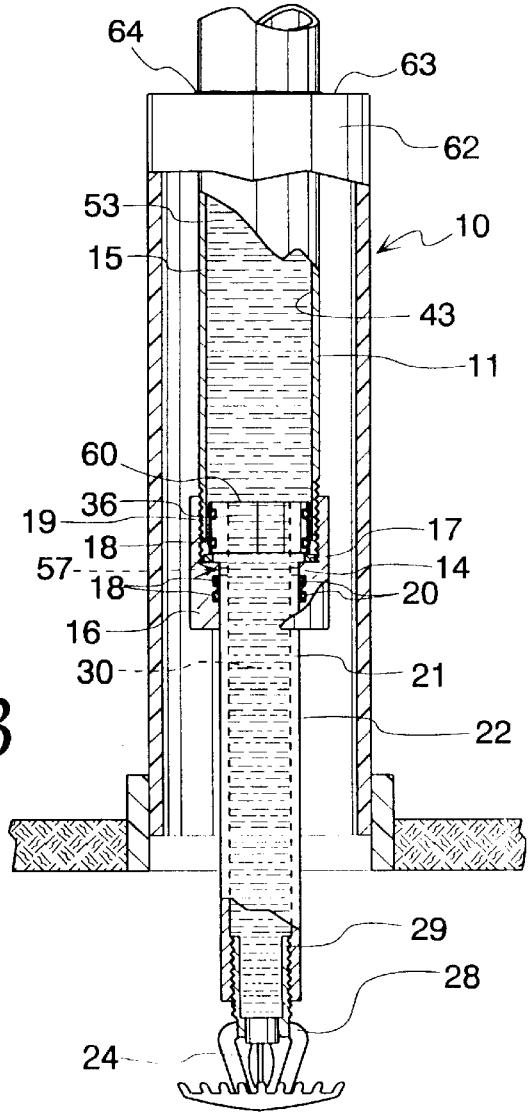
FIG. 3 is a cross sectional view of an exemplary device depicting final deployment, in accordance with features of the present invention.

A commonly used sprinkler head 28 is attached via a male-female threaded configuration to the second end 29 of the piston 21. A second stop 37, having a surface 23 complementary to the surface 26 of the first stop 14, is rigidly attached to the first end 25 of the piston 21 by means of a welded or machine-threaded junction. In FIGS. 1–3, the stop 37 is integrally molded as a machined part 36 having a plurality of annular grooves 20 adapted to receive "O"-rings 18 to serve as a secondary seal.

In FIG. 4, an alternative secondary seal is depicted whereby a compliant annular sleeve such as a gasket 41 is positioned on the piston distal and juxtaposed to the stop 37. The sleeve 41 contacts the inner wall 43 of the outer conduit 11 so as to provide a slidable seal between the stop 37 and the inner wall 43. A groove 44 distal to the gasket 41 provides a means for receiving a snap ring 45 to maintain the gasket 41 in place. Alternatively, an annular plate, coaxial to the piston 21, could be tack-welded onto the piston just distal to the gasket 41 to maintain the position of the gasket. In this latter case, care must be taken not to thermally compromise the gasket 41. Alternatively, the gasket 41 could be stretched over the tack-weld.

The use of O-rings in the secondary seal configuration, as depicted in FIGS. 1–3, obviates the need for the gasket retaining means 45.

Yet a third configuration for providing the secondary seal is through a piston/piston-ring arrangement. In this third configuration, the inner conduit or piston 21 is formed into a honed cylinder adapted to receive one or a plurality of annular rings, such as piston rings, whereby the annular rings are juxtaposed relative to the outer conduit 11 in a manner similar to the O-rings 18 received by the machined part 36 of the secondary seal depicted in FIGS. 1–3. Such a piston-ring arrangement would obviate the expense associated with providing the machined part 36.

The volume between the gasket assembly 18 positioned at the second end 19 of the outer conduit 11 and the secondary seal positioned at the first end 25 of the piston 21 forms an annular chamber or cavity 49. This cavity may be filled by air or by any other suitable fluid hereinafter designated as "piston fluid".

OPERATION DETAIL

Generally, when the device is used in a fire extinguishing system, it is actuated in one of two scenarios. The first scenario is when a fire- or heat-sensing system detects heat or fire, and a high pressure fluid fills the sprinkler system distribution network. The second scenario is when deployment of a telescopic sprinkler system is tested by injecting a high pressure fluid (most often compressed air) in the distribution network. Other suitable pressurized fluids include water, halon, and helium. Typical pressures to which sprinkler systems are subjected can approach, and in some cases exceed, 150 pounds per square inch (psi). For example, pressures of approximately 200 psi may be applied to some telescoping systems.

When a high pressure fluid is introduced in the head space or volume 53 above the piston stop 37, the fluid impacts a fluid-impacting surface 60 of the piston-attached stop 37 thereby causing the piston to travel downwardly towards the second end 19 of the outer conduit. FIG. 2 provides a cross-sectional view of the device at an initial stage of telescopic deployment. FIG. 3 provides a cross-sectional view of the device at its full deployment stage. The piston fluid contained in the cavity 49 is thereby compressed and thus exerts a counterforce which dampens the velocity of the piston.

To expedite evacuation of the piston fluid, portions of the piston 21 may form one or a plurality of venting means such as radially situated channels or apertures 57 to allow for fluid communication between the confined space 49 and the interior 30 of the piston 21. Generally these apertures 57 or bleed holes are positioned distal to the secondary seal region along the piston so as to allow for the escape of the piston fluid from the cavity 49 into the volume 53. The diameter and number of the bleed holes can be adjusted so that the piston 21 is allowed to travel towards the second end 19 of the outer conduit at an appropriate speed. That speed is determined by the impact that can be sustained by the piston stop 37 and the conduit stop 14. One may fashion these bleeder holes so as to maximize the rate of escape of the piston fluid from the piston chamber relative to the rate of entry of the spray fluid into the piston chamber. For instance one may orient the bleeder holes so that the piston fluid will flow downwardly while entering spray fluid will flow upwardly. Moreover, one may make the bleeder holes adjustable in diameter.

Optional gaskets 17 provide a spring-like cushion as the piston-attached stop 37 impacts upon the conduit stop 14. As an alternative or supplement to the gasket 17 resting on top of complementary surface 26, a spring could be employed as a cushioning means, whereby the spring is configured to slidably receive the piston 21, the spring is also configured so that a first end of the spring rests upon the complementary surface 26, and a second end ultimately contacts complementary surface 23 when the piston is substantially deployed. When the first and second ends of the spring are simultaneously contacting the complementary surfaces 26 and 23 respectively, the resistive force of the spring, due to further longitudinal compression of the spring, will serve to cushion deployment impact of the piston-attached stop 37 against the cylinder-attached stop 14.

Optionally, especially when the piston fluid is air, one may provide pressure relief valves (not shown) proximal to the gasket 18 in the second end 19 of the outer conduit 11. These relief valves may be made adjustable to withstand supervisory pressures to which the undeployed system is constantly exposed. This latter option has the further advantage that the relief valves can be activated when "re-nesting" or resetting the pistons after deployment. This option provides a means to evacuate the confined cavity 49 of any fluid such as water contained therein due to leakage or imperfect seal formation.

A myriad of rigid materials are suitable for the two conduits. Relevant to the choice of materials include cost, ability to withstand the high pressures and high velocity impacts associated with the sprinkler system operation, static and kinetic friction between the gaskets and the walls of the conduits, long term durability, and resistance to corrosion.

Also, a wide variety of elastic materials are suitable for gaskets 17, 18, and 41. The choice of materials for the gaskets depends on the smoothness of the walls of the piston and of the outer conduit and the nature of the high pressure and piston fluids. Generally, materials with inherent lubricity are suitable gasket materials, such as various fluorocarbon resins (e.g. polymers of tetrafluoroethylene or hexafluoroproylene). Otherwise, any gasket material that is compatible with silicone grease is suitable, whereby the grease is applied to the gaskets prior to final assembly of the device. In an exemplary embodiment of the present invention, rubber was utilized for gasket 17, neoprene O-rings for gaskets 18, and standard rubber tubing for the gasket 41. Tubing without internal threads or other absorbent, rubber-substrate support means is preferable to minimize wicking of grease.

Lubricity between the gaskets and the opposing inner walls of the device can be further facilitated by coating the surfaces to prevent corrosion. Alternatively, a noncorrosive material such as stainless steel, copper-based alloy, or internally plated metallic surfaces can be utilized.

Lastly, gaskets connected to the secondary seal configuration may not be required if a suitable close tolerance between the piston-attached stop 37 and the inner wall 43 of the outside conduit 11 is obtainable so as to provide slow deployment (i.e., deployment without concomitant damage to the microstructure of the device) of the sprinkler head.

EXAMPLE

An exemplary embodiment of the device was constructed from ordinary materials to illustrate the utility of the invention in radio frequency-shielded environments. Specifically, 1½" schedule 40 black pipe was utilized as the outer conduit 11. The first end 15 of the outer conduit 11 is ideally suited to extend through magnetic field or RF-shielded channels 62 to attach to a water supply network. As depicted in FIGS. 1–3, the channels 62 may be outfitted with a cap plate 63, whereby the cap plate 63 forms an aperture to receive the outer conduit 11. The cap plate may be attached to the outer conduit 11 via welds 64.

The second end 19 or depending end of the outer conduit 11 slidably received an inner conduit or piston 21, which was fabricated from 1-inch stainless steel pipe, schedule 80. As depicted in FIGS. 1–3, the first end 25 of the piston 21 was adapted to receive a 1" NPS×¾" machined part 36, to serve as the integrally molded piston-attached stop 37 and O-ring holder 20.

As noted supra, an alternative piston-attached stop 37 can be configured from 1" NPT×¾" coupling. Juxtaposed distally to the piston-attached stop 37 is the annular sleeve or gasket 41. While any compressible material is suitable to comprise the gasket 41, sections of common rubber hose cut to lengths of approximately ½ inches were utilized.

Once the piston 21 was fully nested concentrically within the cylinder 11, a 1½"×1" reducer coupling was threaded onto the second end 19 (depending end) of the outer cylinder 11. An inner surface of the reducer coupling defines the stop 14 having a surface 26 complementary to an opposing surface 26 of the piston-attached stop 37. The inner surface of the reducer coupling also defined a region to receive one or more O-rings comprised of nitrile rubber.

Initially in the resting or "nested" position, as depicted in FIGS. 1 & 2, the stainless steel pipe/piston 21 is actuated downwardly when a fluid (e.g., water, halon, etc.)of sufficient force impacts the fluid-impacting surface 60 of the piston-attached stop 37. Pressures applied for deployment ranged from approximately 15 pounds per square inch to 40 pounds per square inch.

Generally, deployment pressures can supersede supervisory pressures which often are used to monitor the integrity of the system, such supervisory pressures generally ranging from approximately less than 1 psi to 30 psi. To maintain the piston 21 in its nested configuration while supervisory pressures are applied, and to re-set deployed pistons into the nested configurations, one or more means for retaining the piston may be employed, including, but not limited to, ball plunger configurations whereby a spring-biased pin 12 mates with an annular groove 27 formed on the outer surface 22 of the piston 21, as depicted in FIG. 4. Such piston-retaining means are adjustable to the supervisory air pressure used. An exemplary adjusting means includes a set screw 13 to vary tension of a spring 9 which is applying outward pressure to the pin 12. Exemplary ball-spring plungers for use as the piston-retaining means are available from VLIER INC., Brighton, Mass.

Upon full deployment, see FIG. 3, the system remains charged. Water or other fluid flows through the sprinkler head 22 only when heat links 24 or manual systems are actuated. Typical telescoping sprinkler systems are reset or "re-nested" manually. However, a negative pressure applied remotely from the depending sprinkler pistons also could cause re-nesting to occur. Such negative pressure could be applied to the water network system in a procedure opposite to the application of the deployment pressure.

While the invention has been described with reference to details of the illustrated embodiment, these details are not intended to limit the scope of the invention in the appended claims. For example, while the above description depicts a separate substrate 62 as a radio frequency protection element, the outer conduit 11 of the device could also serve this purpose, thereby precluding the need for element 62 or such additional RF attenuation substrates.

The embodiment of the invention in which an exclusive property or privilege is claimed is defined as follows:

We claim:

1. A device for deploying a sprinkler head in a telescopic sprinkler system comprising a chamber containing fluid for dampening speed of deployment of the sprinkler head.

2. The device as recited in claim 1 further comprising means for allowing escape of said fluid from said chamber at a predetermined rate.

3. The device as recited in claim 2 wherein said fluid is air.

4. The device as recited in claim 1 wherein said chamber is annular in shape and is defined by an inner surface of a cylinder and an outer surface of a piston nested in the cylinder.

5. The device as recited in claim 4 wherein said annular chamber has a first end and a second end, each end terminating with a fluid sealing means, said means circumferentially and simultaneously contacting both the inner surface of the cylinder and the outer surface of the piston nested in the cylinder.

6. The device as recited in claim 5 wherein:

a) the piston has a first end and a second end and the cylinder has a first end and a second end;

b) the fluid sealing means comprises a plurality of gaskets positioned on said first end of said piston; and c) said sprinkler head is attached to said second end of said piston.

7. The device as recited in claim 6 wherein the fluid sealing means further comprises a plurality of gaskets positioned on the second end of said cylinder.

8. The device as recited in claim 6 further comprising a stop attached to the first end of said piston so that when a fluid with sufficient pressure contacts said stop, said piston will travel toward said second end of said cylinder.

9. The device as recited in claim 8 further comprising a stop positioned at said second end of said cylinder.

10. The device as recited in claim 9 further comprising a plurality of means for fluid escape distal to said gaskets positioned on the first end of said piston.

11. The device as recited in claim 8 wherein the pressure is between approximately 15 psi and 200 psi.

12. The device as recited in claim 1 further comprising a means for maintaining the sprinkler head in an undeployed position when predetermined pressures are applied to the system.

13. The device as recited in claim 12 wherein the predetermined pressures range from less than 1 psi to 30 psi.

14. The device as recited in claim 12 wherein the maintaining means is adjustable.

15. The device as recited in claim 1 further comprising a means to deploy the sprinkler head before water flows through the sprinkler head.

16. A device for deploying a sprinkler head in a preaction sprinkler system comprising:

a) a conduit;

b) a hollow piston slidably received by said conduit, whereby said piston has a first end and a second end;

c) a first seal positioned on the first end of said piston;

d) the sprinkler head positioned on the second end of said piston, e) a second seal positioned on said conduit and circumferentially contacting a surface of said piston proximal to the sprinkler head so as to define a fluid space containing a piston fluid between said first seal and said second seal when said piston is substantially contained by said conduit; and f) a stop attached to the first end of said piston and proximal to said first seal so that when a pressurized fluid contacts a proximal surface of said stop with sufficient pressure, said piston will travel toward said second seal a predetermined distance while simultaneously compressing said fluid space.

17. The device as recited in claim 16 wherein the pressurized fluid is selected from the group consisting of air, water, halon, helium, and combinations thereof.

18. The device as recited in claim 16 wherein the pressure is between approximately 15 psi and 185 psi.

19. The device as recited in claim 16 further comprising a means in said piston for evacuating the piston fluid in the fluid space.

20. The device as recited in claim 19 wherein said evacuating means is a plurality of regions on said piston forming radial apertures.

21. A device for deploying a sprinkler head in a preactive sprinkler system comprising:

a) a first conduit having first and second ends;

b) a second conduit longitudinally received within said first conduit;

c) said second conduit having a first end with a first sealing means attached thereto for sealing an outer wall portion of said first end of said second conduit adjacent to a longitudinally varying inner wall portion of said first conduit;

d) said second conduit having a second end with the sprinkler head attached thereto;

e) a second means for sealing an inner wall portion of said second end of said first conduit adjacent to a longitudinally varying outer wall portion of said second conduit;

f) means for regulating deployment speed of the sprinkler head; and g) means for stopping said first end of said second conduit when a predetermined longitudinal movement of said second conduit has occurred.

22. The device as recited in claim 21 wherein said sealing means attached to said first and second conduits include gaskets.

23. The device as recited in claim 22 wherein said gaskets comprise O-rings.

24. The device of claim 21 wherein said first sealing means and second sealing means defines a fluid space, and wherein said regulating means allows for fluid communication between the fluid space and an interior of the second conduit.

25. The device as recited in claim 21 wherein said stopping means includes a first member integrally joined to an outer wall portion of said first conduit coming into contact with a second member integrally joined to an outer wall portion of said second conduit.

* * * * *